US006634340B2

(12) United States Patent
Häberlein et al.

(10) Patent No.: US 6,634,340 B2
(45) Date of Patent: Oct. 21, 2003

(54) FOUR-STROKE ENGINE

(75) Inventors: Jürgen Häberlein, Murrhardt (DE); Roger Ziegler, Mainhardt (DE)

(73) Assignee: Andreas Stihl AG & Co. (DE)

( * ) Notice: Subject to any disclaimer, the term of this patent is extended or adjusted under 35 U.S.C. 154(b) by 88 days.

(21) Appl. No.: 09/935,410

(22) Filed: Aug. 22, 2001

(65) Prior Publication Data

US 2002/0029767 A1 Mar. 14, 2002

(30) Foreign Application Priority Data

Aug. 22, 2000 (DE) ..... 100 41 010

(51) Int. Cl.[7] ..... F02M 37/04
(52) U.S. Cl. ..... 123/509; 123/DIG. 5
(58) Field of Search ..... 123/509, DIG. 5, 123/198; 417/395, 479, 540

(56) References Cited

U.S. PATENT DOCUMENTS 3,160,682 A * 12/1964 Carlson et al. ..... 261/35
4,548,173 A * 10/1985 Yabumoto et al. ..... 123/308
4,903,655 A * 2/1990 Vonderau et al. ..... 123/198 C
6,176,206 B1 * 1/2001 Ishikawa et al. ..... 123/73 C

FOREIGN PATENT DOCUMENTS

DE 4227433 C2 2/1993

* cited by examiner

*Primary Examiner*—Mahmoud Gimie
(74) *Attorney, Agent, or Firm*—R W Becker & Associates; R W Becker

(57) ABSTRACT

A four-stroke engine is provided and has a cylinder and a piston that delimits a combustion chamber and by means of a connecting rod drives a crankshaft disposed in a crankcase. To drive a fuel pump, the fluctuating inner pressure in the crankcase, in the valve housing or in a connecting passage that connects the two housings is utilized. For this purpose, a drive chamber of the fuel pump is connected via a pulse line with a crankcase, a valve housing or the connecting passage.

11 Claims, 3 Drawing Sheets

12
49
28
29
30
14
41
40
43
12'
48
47
44
46
27

2
10
36'
9
37
36
4
3
33
8
32
5
19
6
a
45
31
12
38
42
14
27
13
16
26
1

FOUR-STROKE ENGINE

BACKGROUND OF THE INVENTION

The present invention relates to a four-stroke engine. DE 42 27 433 C2 discloses a four-stroke engine for portable implements and has a diaphragm carburetor, whereby for the drive of a fuel pump of the carburetor, the pressure pulsations in the intake pipe between the carburetor and the cylinder are utilized. For this purpose, a pressure chamber of the intake channel communicates via a pulse line with the drive chamber of the pump. During operation of such four-stroke engines, it has been shown that the pressure fluctuations in the intake pipe are not always sufficient for driving the fuel pump. In particular during acceleration, during rapid opening of the butterfly valve of the diaphragm-type carburetor, a break in pressure occurs that limits the fuel supply.

It is therefore an object of the present invention to ensure a reliable supply of fuel in all operating situations for such a four-stroke engine.

BRIEF DESCRIPTIONS OF THE DRAWINGS

This object, and other objects and advantages of the present invention, will appear more clearly from the following specification in conjunction with the accompanying schematic drawings, in which.

Figures 2, 2A:
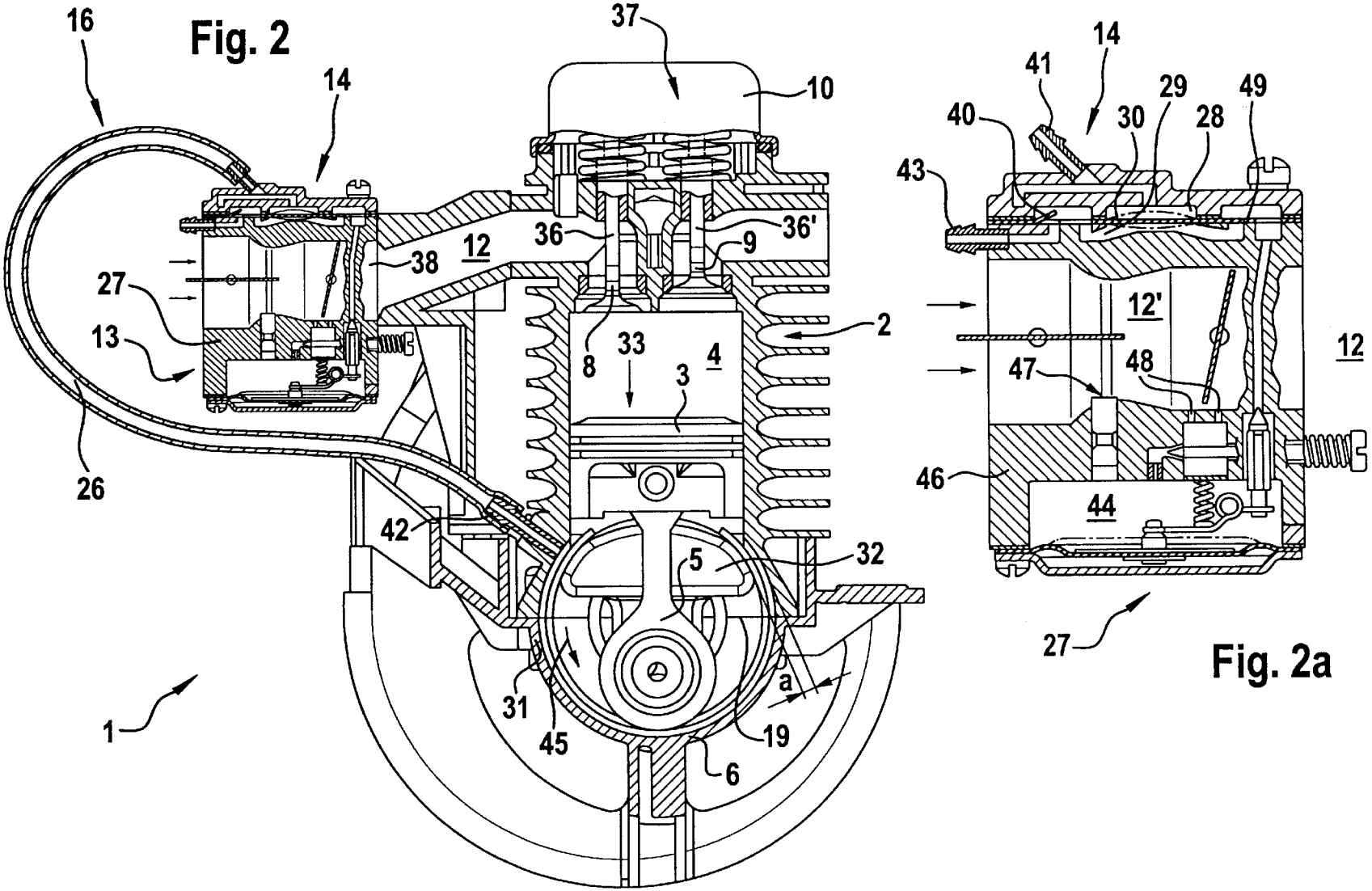
FIG. 2 is a cross-sectional view through a mixture or fuel lubricated four-stroke engine transverse to the crankshaft.
Figure 3:
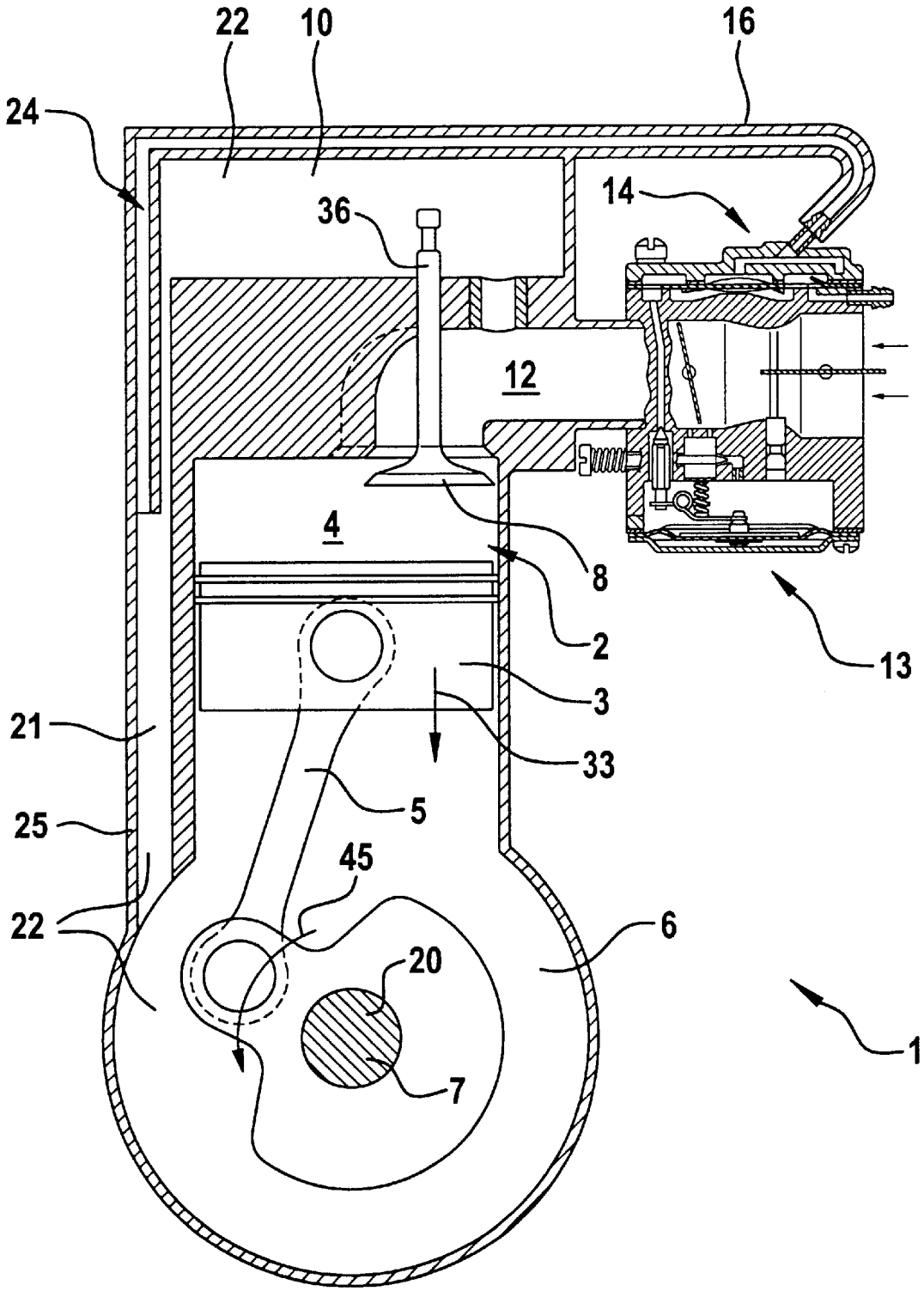

FIG. 2*a* is a longitudinal section through a diaphragm-type carburetor; and FIG. 3 is a schematic sectional view through the four-stroke engine of FIG. 2.

SUMMARY OF THE INVENTION

The four-stroke engine of the present invention comprises a cylinder, and a piston that delimits a combustion chamber and by means of a connecting rod drives a crankshaft that is disposed in a crankcase; an intake valve and an exhaust valve are provided in a valve housing for the combustion chamber, with the valves being actuated from the valve housing via a valve driving mechanism that is driven by the crankshaft; a mixture preparation device communicates with the intake valve via an intake channel; an inner chamber of the crankcase is embodied as an essentially closed flow chamber and is in fluid communication with a pulse line; and a fuel pump also communicates with the intake valve via the intake channel and, via the pulse line, is driven exclusively by pressure pulsations in the crankcase.

It has been surprisingly shown that during operation of a four-stroke engine having a crankcase that is essentially closed off towards the outside, the fluctuating pressure in the interior of the crankcase is suitable for reliably driving a fuel pump of a mixture preparation device. The piston, which moves up and down, i.e. reciprocates, during the operation of a four-stroke engine effects a changing pressure level in the crankcase if the interior of the crankcase is embodied as a largely closed flow chamber. The pulse-like pressure fluctuations in the interior of the crankcase, which interior is cut off or separated from the surrounding atmosphere, are sufficient for driving a diaphragm pump which is in fluid communication with the crankcase via a pulse line. To prevent lubricating oil from entering the pulse line, it is expedient to dispose the branching off of the pulse line from the interior of the crankcase at a suitable location between the crankshaft and cylinder on an endface of the crankcase.

It can be expedient to allow the pulse line to branch off from the crankcase below a cylinder flange of the cylinder of the four-stroke engine transverse to the longitudinal axis of the crankshaft. Especially if the four-stroke engine is to be used in different positions, for example if it is used in a manually guided implement, it is expedient for the four-stroke engine to be a mixture or fuel lubricated four-stroke engine. The intake channel is advantageously connected with the valve housing via a connection between the mixture preparation device and the intake valve. The valve housing is in turn in fluid communication with the crankcase via a connection channel that surrounds the valve driving mechanism, so that a continuous flow chamber is formed that is comprised of the crankcase, the connecting channel, and the valve housing. In the flow chamber, during the operation of a four-stroke engine, the cyclically fluctuating pulse-like pressure spreads out from the crankcase.

It can be expedient to provide the branching of the pulse line on the crankcase of the four-stroke engine itself. To reduce the length of the pulse line, it can branch off at the connecting channel or on the valve housing of the four-stroke engine. To prevent disruptions from occurring, it is expedient to branch the pulse line from the flow chamber transverse to a wall that delimits the flow chamber. As a consequence of these structural features, the entry of lubricating oil or fuel/lubricating oil mixture into the pulse line is additionally minimized.

It is expedient to form the pulse line entirely or at least partially as a channel in the engine housing, which is formed by the crankcase, the cylinder housing and the valve housing. The mixture preparation device is preferably embodied as a diaphragm-type carburetor, whereby the fuel pump is provided on the diaphragm-type carburetor and is essentially formed of a working or drive chamber, a pump chamber, and a pump diaphragm that is disposed between the drive chamber and the pump chamber and provides a fluid separation between the two chambers. In this connection, the pulse line is in fluid communication with the drive chamber of the fuel pump and actuates the pump diaphragm by the cyclical, pulse-like pressure that during operation of the four-stroke engine is present in the pulse line. To maximize the pulse-like pressure in the interior of the crankcase, it is expedient to minimize the volume of the interior of the crankcase by means of a partition or delimiting wall. When viewed in a radial direction relative to the longitudinal axis of the crankshaft, a wall is disposed for this purpose in the vicinity of the crank webs in the crankcase.

Further specific features of the present invention will be described in detail subsequently.

DESCRIPTION OF PREFERRED EMBODIMENTS

Figure 1:
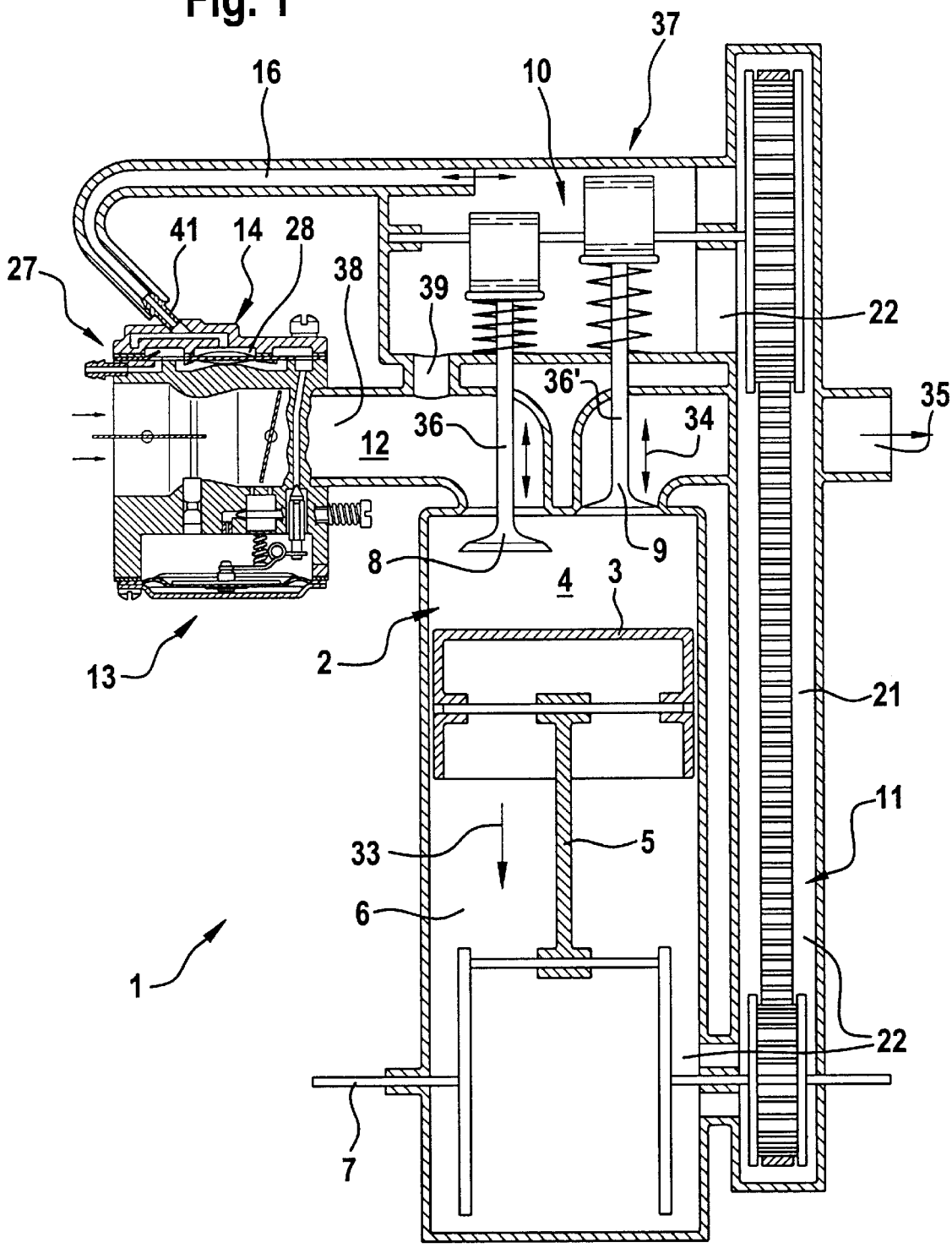
FIG. 1 is a cross-sectional view through one exemplary embodiment of an inventive mixture or fuel lubricated four-stroke engine.

Referring now to the drawings in detail, FIGS. 1 and 2 show a cross-section through a four-stroke engine, especially through a mixture or fuel lubricated four-stroke engine 1. The engine 1 essentially comprises a cylinder 2 in which is disposed a piston 3 that delimits a combustion chamber 4 formed in the cylinder 2 and that by means of a piston or connecting rod 5 drives a crankshaft 7 that is disposed in a crankcase 6. Disposed in the cylinder 2 are an intake valve 8 and an exhaust valve 9, by means of which the ignitable mixture or fuel is supplied and the exhaust gases withdrawn respectively. Valve stems 36, 36' of the valves 8 and 9 extend into a valve housing 10 and are moved up and down in the direction of the arrow 34 by means of a cam drive 37. The cam drive 37, in turn, is driven by a valve driving mechanism 11 from the crankshaft 7 that is mounted in the crankcase 6. In the illustrated embodiment, the valve driving mechanism 11 is embodied as a belt or chain drive disposed in a connecting passage 21, which at the same time represents a flow connection between the crankcase 6 and the valve housing 10. The crankcase 6, the connecting passage 21, and the valve housing 10 form a flow chamber 22 that is closed to the outside and that is in fluid communication with the intake channel 12 of the four-stroke engine 1 by means of an opening 39 in the intake channel 12. A mixture preparation device 13 is flanged onto the intake channel 12 at an inlet or intake opening 38 of the cylinder 2. In the illustrated embodiment, the mixture preparation device 13 is embodied as a diaphragm-type carburetor 27.

With the intake valve 8 opened, and the piston 3 moving downward in the direction of the arrow 33, an air/fuel/lubricating oil mixture is drawn in via the intake channel 12 from the mixture preparation device 13. At the same time, an overpressure results in the flow chamber 22, proceeding from the crankcase 6. In the compression cycle that follows the intake cycle, the piston 3 moves upwardly opposite to the direction of the arrow 33, whereby both the intake valve 8 and the exhaust valve 9 are closed. As a consequence of the upwardly moving piston 3, a partial vacuum results in the crankcase 6 and also continues into the valve housing 10 via the connecting passage 21. This draws an air/fuel/lubricating oil mixture into the flow chamber 22 for lubrication of the moving parts of the four-stroke engine 1.

Following the conclusion of the compression stroke are the ignition and hence the power stroke, with the crankshaft 7 being driven in the direction of the arrow 45 (see FIG. 2). After the power stroke, the exhaust valve 9 opens and the gases resulting in the combustion chamber 4 are discharged via an exhaust channel 35. In the intake stroke that follows, the piston 3 again moves downwardly in the direction of the arrow 33 (FIG. 1), as a result of which an overpressure builds up in the crankcase 6. Due to the reciprocating movement of the piston 3, a pulse-like changing internal pressure builds up in the flow chamber 22. The cyclical pressure fluctuations in the flow chamber 22, which is essentially closed off towards the outside and is formed by the crankcase 6, the connecting passage 21, and the valve housing 10, are suitable for driving a fuel pump 14, which is part of the mixture preparation device 13. In the embodiment shown in FIGS. 1–3, the mixture preparation device 13 is expediently embodied as a diaphragm-type carburetor 27. By means of a pulse line 16, the fuel pump 14 is in fluid communication with the flow chamber 22. The pulse-like pressure that cyclically forms in the flow chamber 22 drives the fuel pump 14 by means of the pulse line 16.

As shown in FIG. 2*a,* the diaphragm-type carburetor 27 comprises a carburetor housing 46 having an intake channel 12' that is formed therein and passes there through, and that continues into the intake channel 12 of the cylinder 2. Formed in the carburetor housing 46 are the fuel pump 14 as well as a fuel-filled control chamber 44. From the control chamber 44, the nozzles 47,48, which open into the intake channel 12', are supplied with fuel.

The fuel pump 14 comprises a pump chamber 29 that is delimited by a pump diaphragm 30 and that on the input and output sides communicates with a respective check valve 49, 40 that opens in the direction of flow of the fuel. Formed on the back side of the pump diaphragm 30 that is opposite from the pump chamber 29 is a drive chamber 28 that communicates with the flow chamber 22 by means of a pressure connection 41 and the pulse line 16. The fluctuating pressure in the flow chamber 22 effects alternating bulging of the pump diaphragm 30 in alternating directions, and hence effects a conveyance of the fuel from a non-illustrated fuel supply container to the control chamber 44 via an inlet connection 43 of the fuel pump 14.

The pulse line 16 can expediently be connected to a connector 42 on the crankcase 6, and can extend as a separate pulse line 26 outside of the motor housing, as shown in FIG. 2. In this connection, the connector 42 is integrally formed with the crankcase 6, transverse to the longitudinal axis or shaft 20 of the crankshaft 7, below a cylinder flange 19 for the cylinder 2. This structural measure prevents entry of lubricating oil or fuel/lubricating oil mixture into the pulse line. The pulse line advantageously always opens transverse to a flow that forms in the flow chamber during operation. However, as shown in FIG. 1, it can be expedient to have the pulse line 16 branch off from the valve housing 10. The pulse line 16 is advantageously formed as a channel 24 that extends in the engine housing 25 (see FIG. 3). To increase the pulse-like pressure in the flow chamber, and hence to thereby provide for better control of the pump diaphragm, it is expedient to minimize the volume of the interior of the crankcase. For this purpose, the crankcase 6 is provided with a wall 31 (FIG. 2) that preferably extends in a radial direction relative to the longitudinal axis of the crankshaft, and that is disposed at a slight distance "a" relative to the crank web 32 of the crankshaft 7 and reduces the interior space of the crankcase.

The specification incorporates by reference the disclosure of German priority document 100 41 010.3 of Aug. 22 2000.

The present invention is, of course, in no way restricted to the specific disclosure of the specification and drawings, but also encompasses any modifications within the scope of the appended claims.

What is claimed is:

1. A four-stroke engine comprising a cylinder, and a piston that delimits a combustion chamber and by means of a connecting rod drives a crankshaft disposed in a crankcase, wherein a valve housing is provided and has an intake valve and an exhaust valve for the combustion chamber, wherein said valves are actuated from said valve housing via a valve driving mechanism that is driven by said crankshaft, wherein a mixture preparation device is provided that communicates with the intake valve via an intake channel, wherein an inner chamber of said crankcase is embodied as an essentially closed flow chamber and is in fluid communication with a pulse line, wherein a fuel pump is provided that also communicates with the intake valve via the intake channel and that, via said pulse line, is driven exclusively by pressure pulsations in said crankcase, wherein said four-stroke engine is mixture lubricated, wherein said valve housing is connected with said intake channel of said mixture preparation device and is connected with said crankcase via a connecting passage, and wherein a volume of said inner chamber of said crankcase, a volume of said valve housing and a volume of said connecting passage form a continuous flow chamber.

2. A four-stroke engine according to claim 1, wherein said pulse line branches off from said valve housing.

3. A four-stroke engine according to claim 1, wherein said pulse line branches off from said flow chamber.

4. A four-stroke engine according to claim 1, wherein a wall is provided for delimiting said flow chamber, and wherein said pulse line branches off from said flow chamber transverse to said wall.

5. A four-stroke engine comprising a cylinder, and a piston that delimits a combustion chamber and by means of a connecting rod drives a crankshaft disposed in a crankcase, wherein a valve housing is provided and has an intake valve and an exhaust valve for the combustion chamber, wherein said valves are actuated from said valve housing via a valve driving mechanism that is driven by said crankshaft, wherein a mixture preparation device is provided that communicates with the intake valve via an intake channel, wherein said four-stroke engine is mixture lubricated wherein an inner chamber of said crankcase is embodied as an essentially closed flow chamber and is in fluid communication with a pulse line, and wherein a fuel pump is provided that also communicates with the intake valve via the intake channel and that, via said pulse line, is driven exclusively by pressure pulsations in said crankcase.

6. A four-stroke engine according to claim 5, wherein said pulse line branches off from an endface of said crankcase between said crankshaft and said cylinder.

7. A four-stroke engine according to claim 5, wherein said pulse line branches off from said crankcase below a cylinder flange for said cylinder transverse to a longitudinal axis of said crankshaft.

8. A four-stroke engine according to claim 5, wherein said pulse line is formed at least partially as a channel in a housing of said engine.

9. A four-stroke engine according to claim 5, wherein said pulse line is provided as a separate line disposed outside of a housing of said engine.

10. A four-stroke engine according to claim 5, wherein a wall is disposed in said crankcase in the vicinity of a crank web thereof, and wherein said wall extends in a radial direction relative to a longitudinal axis of said crankshaft and delimits the inner chamber of the crankcase.

11. A four-stroke engine comprising a cylinder, and a piston that delimits a combustion chamber and by means of a connecting rod drives a crankshaft disposed in a crankcase, wherein a valve housing is provided and has an intake valve and an exhaust valve for the combustion chamber, wherein said valves are actuated from said valve housing via a valve driving mechanism that is driven by said crankshaft, wherein a mixture preparation device is provided that communicates with the intake valve via an intake channel, wherein an inner chamber of said crankcase is embodied as an essentially closed flow chamber and is in fluid communication with a pulse line, wherein a fuel pump is provided that also communicates with the intake valve via the intake channel and that, via said pulse line, is driven exclusively by pressure pulsations in said crankcase, wherein said mixture preparation device is a diaphragm-type carburetor, wherein said fuel pump comprises a drive chamber, a pump chamber and a pump diaphragm that is disposed between the drive chamber and the pump chamber, and wherein said pulse line opens into said drive chamber.

* * * * *